United States Patent [19]

Meimeteas

[11] Patent Number: 4,751,762

[45] Date of Patent: Jun. 21, 1988

[54] PAINT BRUSH COVER

[76] Inventor: Angelo Meimeteas, 68 Warren St., Lynn, Mass. 01905

[21] Appl. No.: 85,362

[22] Filed: Aug. 14, 1987

[51] Int. Cl.[4] ..... A46B 17/02

[52] U.S. Cl. ..... 15/246; 15/143 R; 206/361; 16/110 R

[58] Field of Search ..... 15/248 R, 246, 247, 15/168, 169, 170, 175, 143 R, 192, 193, 194, 184; 206/361; 16/110 R, DIG. 18, DIG. 19

[56] References Cited

U.S. PATENT DOCUMENTS 1,133,622 3/1915 Darling ..... 15/143 R
1,445,968 2/1923 Levenson ..... 15/143 R
2,309,990 2/1943 Savi ..... 15/174
4,283,808 8/1981 Beebe ..... 15/167.1

*Primary Examiner*—Peter Feldman
*Attorney, Agent, or Firm*—Paul J. Cook

[57] ABSTRACT

An integral cover for a paint brush is provided which is formed from a rubber composition and includes a cover handle section, a cover ferrule section and a cover neck section which connects the cover handle section and the cover ferrule section. The cover is provided with a hook which is formed integrally with the remaining portion of the cover which permits a paint brush to be hung onto the edge of a container of paint or paint thinner.

12 Claims, 2 Drawing Sheets

PAINT BRUSH COVER

BACKGROUND OF THE INVENTION

This invention relates to a paint brush cover and more specifically to a paint brush cover adapted to protect the paint brush from contact with paint or paint thinner, with the exception of the bristle portion of the brush.

Generally a paint brush is formed from bristles, a bristle mounting, a metal ferrule which covers the bristle mounting and a handle which is attached to or comprises a one piece construction with the bristle mounting. After a paint brush is used, it is washed in a thinner such as water or mineral spirits and then is reused. It is common practice to insert a nail into the wooden portion of the handle adjacent the ferrule and to bend the nail so that the brush can be hung on the lip of a container containing the thinner or paint when the brush is not in use. When the brush is hung for excessive times in the thinner, it is common that the thinner will accumulate in the volume surrounded by the metal ferrule and the bristle mounting.

It has been proposed in U.S. Pat. No. 1,130,759 to utilize a metal paint brush cover which is fit around the paint brush handle adjacent the ferrule portion of the brush. The cover is not fit to contact the entire ferrule but is shaped in the form of a cup whereby a space is formed between the cover and the ferrule in order to retain excess paint or thinner which may have been accepted by the brush. The cover is provided with a hook so that the paint brush can be hung from the edge of a container for paint or thinner. Since the paint brush handle is not a precisionally made component, the variation in size and shape of a paint brush handle for a given standard size paint brush will vary. Given this fact and the fact that a paint brush cover is made of a metal which is relatively inflexible, leakages will occur from the volume within the paint brush cover onto the handle which will cause caking of paint on the handle. This is undesirable since it makes the brush heavier due to the cumulative effect of caking paint and since the brush is used for different colored paint, colors from the paint on the handle will be deposited during subsequent use with a different colored paint. The problem of leakage is particularly acute with thinner since thinner is a far less viscous liquid than paint. The thinner will accumulate in the space between the bristle holder and the ferrule by being passed into the space by capillary action when the paint brush is hung into the thinner. Thus, when the position of the brush is reversed so that the brush is positioned above the handle, the thinner will leak past the ferrule onto the handle and will not be stopped by the cover since the metal cover can not be precisely fit onto the handle portion adjacent the ferrule. In addition, since the handle is exposed, inevitably, it will be coated with excess paint due to splattering or dripping from the painted area or through other means such as by accidental overdipping of the paint brush into the paint. Thus, inevitably, the handle will be caked with paint and the brush must be discarded.

It has been proposed in U.S. Pat. No. 2,733,471 to utilize a rubber paint brush cover which fits around the ferrule portion of the paint brush adjacent the handle. The paint brush cover is provided with fingers so that the cover is angled away from the ferrule to form a volume between the ferrule and the paint brush cover into which excess paint or paint thinner can be retained.

The handle of the brush is maintained exposed in order to prevent interference with conventional use of the brush. However, since paint inevitably splatters or drips during use of the paint brush from sources other than the bristles, the handle of the brush inevitably becomes covered with paint, and, for the reasons set forth above, the paint brush must be discarded.

Various brush covers are disclosed for example in U.S. Pat. Nos. 4,392; 860,527; 1,501,020; 1,720,868; 2,237,969; 2,485,068; 2,958,087; 3,106,738; 3,193,863; 3,968,950 and 4,001,909.

It would be desirable to provide a paint brush cover which protects the brush handle from being coated with paint and which prevents excess thinner retained by the brush from spilling onto the user during use of the paint brush. Furthermore, it would be desirable to provide such a brush which does not interfere with the conventional use of the brush or which actually improves the conventional use of the brush.

SUMMARY OF THE INVENTION

In accordance with this invention, a hollow flexible rubber cover for a paint brush is provided which fits over the handle section and the ferrule section of the brush. The cover is hollow and has an opening of a size so that the handle and ferrule section of the brush can fit into the cover and so that the cover portion surrounding an opening for the cover fits tightly about the ferrule section of the brush so as to prevent liquid from entering the interior of the cover. The cover is formed from a stretchable flexible rubber composition. By "rubber" as used herein is meant compositions formed from natural rubber or synthetic plastics or rubbers which are stretchable and which may or may not contain additives such as fillers or pigments. The cover is provided with a hook which is integrally formed with the cover so that, when the cover is in place on the paint brush, the cover and paint brush can be hung on the lip of a container for paint or paint thinner.

DESCRIPTION OF SPECIFIC EMBODIMENTS

The cover of this invention comprises an integral structure formed from a flexible stretchable rubber composition such as natural latex or synthetic polymers including polyvinylchloride or the like which may or may not contain additives such as fillers, dyes or pigments. The cover can be formed by any conventional means such as injection molding or dipping or spraying on a male form. The cover is provided with a hook which is integrally formed with the remaining portion of the cover. The hook can be positioned on the cover ferrule section or the neck section which connects the cover ferrule section to the cover handle section. It is preferred that the hook not be positioned on the cover handle section since it would interfere with the painter during use.

Figure 1:
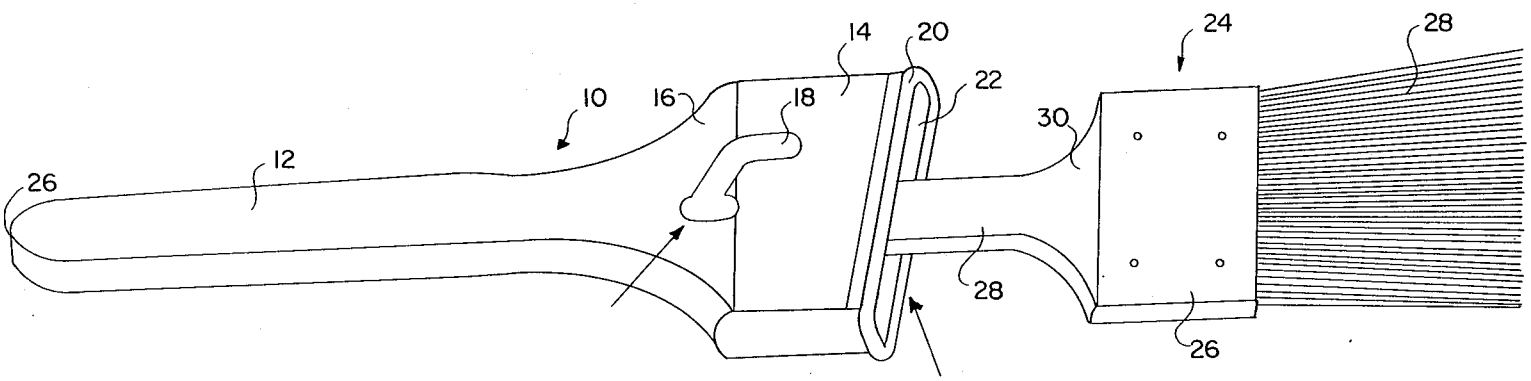
FIG. 1 is an isometric view showing the cover of this invention and its relationship to a paint brush.
Figure 2:
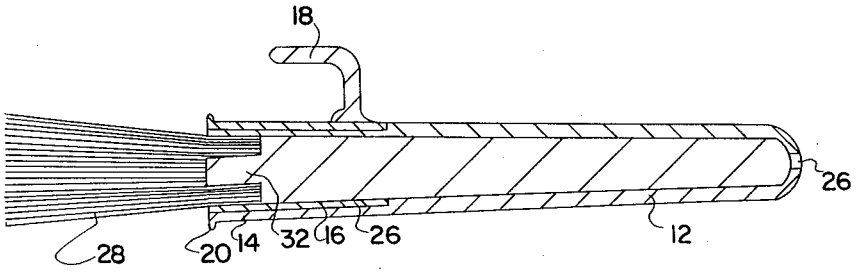
FIG. 2 is a longitudinal cross-sectional view of the cover and brush of FIG. 1 when the cover is in place over the brush.

Referring to the Figures, the paint brush cover 10 includes a cover handle section 12 a cover ferrule section 14 and a neck section 16 which joins the cover handle section 12 and the cover ferrule section 14. The cover 10 also includes a hook 18. The cover 10 is of integral construction. Optionally, the cover 10 can include a lip 20 which surrounds opening 22. The lip 20 functions to impede or prevent paint from the paint brush 24 from spilling onto the outside surface of the cover 10. The cover 10 can be provided with a hole 26 at the end of the cover handle section 12 so that air within the cover 10 can be expelled from the cover 10 as the paint brush 24 is insetted into the cover 10. The size of the opening 22 is such as to permit insertion of the paint brush 24 into the cover 10 and so that the inner surface of the opening 22 fits tightly around the ferrule 26 of the paint brush 24 thereby preventing leakage of liquid into the inner surfaces of the cover 10. The paint brush handle 28 fits into the cover handle section 12. The neck section 30 fits into the cover neck section 16. The ferrule 26 fits into the ferrule cover section 14. When the paint brush 24 is fully inserted into the cover 10 the brush section 28 is exposed for insertion into the paint or paint thinner. As shown in FIG. 2, the brush 28 extends from the bristle mounting section 32.

The opening 22 can be expanded by stretching the lip 20 so that one cover 10 can accomodate more than one size brush. Typical brush size are those having a width across the ferrule of 1 inch, 2 inches, 2½ inches, 3 inches, 4 inches, 5 inches or 6 inches or larger.

The cover of this invention provides substantial advantages over the prior art. The rubber forming the cover provides improved feel and tactile sense over the presently utilized materials for brush handles including plastic or wood. Furthermore, the cover of this invention eliminates the use of nails that are presently commonly used and therefore does not damage the brush. The cover of this invention protects the entire handle of the paint brush and therefore greatly extends the life of the paint brush since it prevents paint from accumulating on the handle. Any paint which may accumulate on the cover handle section can be removed easily since the cover handle section is lexible. Thus, by deforming the cover handle section after removing it from the paint brush, any accumulated paint thereon will crack and can be easily removed manually. Even flexible latex paint or partially dried paint can be removed from the cover handle section easily by deforming it and then peeling the accumulated flexible paint therefrom. The hook permits hanging the paint brush onto the edge of a container for the paint or thinner and therefore promotes ease of use. Even when the cover and paint brush are hung in a thinner, any thinner which accumulates in the bristle mounting section beneath the ferrule will not run onto the user when the paint brush is inverted since any thinner will pass from the bristle mounting section into the interior of the cover and will be retained therein. Thus, the cover of this invention greatly extends the useful life of a paint brush and provides improved use of the brush due to the improved tactile sense of the handle and the elimination of dripping of thinner or paint onto the user.

I claim:

1. A hollow flexible rubber cover for a paint brush having a handle section, a bristle mounting section attached to said handle section, a ferrule surrounding said bristle mounting section and a bristle brush secured between said bristle mounting section and said ferrule which comprises a cover handle section, a cover ferrule section formed integrally with said cover section, said cover ferrule section having an opening of a size to permit insertion of a paint brush into said cover and to seal the interior of said cover to prevent liquid from entering said interior and a hook formed integrally with said cover, said hook extending in a direction toward said opening, said cover being shaped to make a tight contact fit with the entire handle and ferrule sections.

2. The cover of claim 1 including a lip positioned around said opening, said lip being formed integrally with said cover.

3. The cover of claim 1 having a small opening at an end of said cover handle section opposite said opening.

4. The cover of claim 2 having a small opening at an end of said cover handle section opposite said opening.

5. The cover of claim 1 wherein said hook is positioned between said cover handle section and cover ferrule secion.

6. The cover of claim 2 wherein said hook is positioned between said cover handle section and said cover ferrule section.

7. The cover of claim 3 wherein said hook is positioned between said cover handle section and said cover ferrule section.

8. The cover of claim 4 wherein said hook is positioned between said cover handle and cover ferrule section.

9. The cover of claim 1 wherein said hook is positioned on said cover ferrule section.

10. The cover of claim 2 wherein said hook is positioned on said cover ferrule section.

11. The cover of claim 3 wherein said hook is positioned on said cover ferrule section.

12. The cover of claim 4 wherein said hook is positioned on said cover ferrule section.

* * * * *